US008905711B2

(12) United States Patent
Suciu et al.

(10) Patent No.: US 8,905,711 B2
(45) Date of Patent: Dec. 9, 2014

(54) CERAMIC MATRIX COMPOSITE VANE STRUCTURES FOR A GAS TURBINE ENGINE TURBINE

(75) Inventors: Gabriel L. Suciu, Glastonbury, CT (US); Ioannis Alvanos, West Springfield, MA (US); Brian D. Merry, Andover, CT (US); Christopher M. Dye, Glastonbury, CT (US)

(73) Assignee: United Technologies Corporation, Hartford, CT (US)

( * ) Notice: Subject to any disclaimer, the term of this patent is extended or adjusted under 35 U.S.C. 154(b) by 487 days.

(21) Appl. No.: 13/116,053

(22) Filed: May 26, 2011

(65) Prior Publication Data

US 2012/0301285 A1 Nov. 29, 2012

(51) Int. Cl.

| | |
|---|---|
| ***F04D 29/54*** | (2006.01) |
| ***F01D 9/04*** | (2006.01) |
| ***F01D 5/28*** | (2006.01) |
| ***F01D 25/24*** | (2006.01) |
| ***F01D 5/14*** | (2006.01) |
| ***F01D 11/00*** | (2006.01) |

(52) U.S. Cl.

CPC ..... *F01D 5/284* (2013.01); *F01D 9/041* (2013.01); *F01D 5/282* (2013.01); *F01D 25/246* (2013.01); *F01D 5/147* (2013.01); *F05D 2300/6033* (2013.01); *F01D 11/001* (2013.01); *F05D 2240/12* (2013.01)

USPC ..... 415/193; 415/191; 415/209.3; 415/209.4; 415/210.1

(58) Field of Classification Search

USPC ..... 415/209.4, 210.1, 193, 209.3

See application file for complete search history.

(56) References Cited

U.S. PATENT DOCUMENTS

| | | | | |
|---|---|---|---|---|
| 3,362,681 | A | 1/1968 | Smuland | |
| 5,545,002 | A * | 8/1996 | Bourguignon et al. | 415/115 |
| 6,200,092 | B1 | 3/2001 | Koschier | |
| 6,890,150 | B2 * | 5/2005 | Tomberg | 415/173.4 |
| 6,910,859 | B2 * | 6/2005 | Bluhm et al. | 415/191 |
| 7,093,359 | B2 | 8/2006 | Morrison et al. | |
| 7,112,042 | B2 | 9/2006 | Tatsumi et al. | |
| 7,247,002 | B2 | 7/2007 | Albrecht et al. | |
| 7,343,676 | B2 * | 3/2008 | Ng | 29/889.1 |
| 7,452,182 | B2 * | 11/2008 | Vance et al. | 415/135 |
| 7,704,042 | B2 * | 4/2010 | Brueckner et al. | 415/189 |
| 7,824,152 | B2 | 11/2010 | Morrison | |
| 8,147,189 | B2 | 4/2012 | Girard et al. | |
| 2007/0122266 | A1 | 5/2007 | Cairo et al. | |
| 2007/0297900 | A1 * | 12/2007 | Abgrall et al. | 415/209.3 |
| 2009/0238682 | A1 * | 9/2009 | Clemen | 415/159 |
| 2010/0068034 | A1 | 3/2010 | Schiavo et al. | |
| 2010/0108661 | A1 * | 5/2010 | Vontell et al. | 219/477 |
| 2010/0189556 | A1 | 7/2010 | Propheter-Hinckley et al. | |
| 2012/0279631 | A1 | 11/2012 | Mizokami et al. | |

FOREIGN PATENT DOCUMENTS

| | | |
|---|---|---|
| JP | 2003148105 | 5/2003 |
| JP | 2006089796 | 4/2006 |
| JP | 2010001777 | 1/2010 |
| WO | 2011059064 | 8/2001 |

* cited by examiner

*Primary Examiner* — Edward Look
*Assistant Examiner* — Michael Sehn
(74) *Attorney, Agent, or Firm* — Carlson, Gaskey & Olds, P.C.

(57) ABSTRACT

A vane structure for a gas turbine engine according includes a multiple of CMC airfoil sections integrated between a CMC outer ring and a CMC inner ring.

12 Claims, 3 Drawing Sheets

CERAMIC MATRIX COMPOSITE VANE STRUCTURES FOR A GAS TURBINE ENGINE TURBINE

BACKGROUND

The present disclosure relates to a gas turbine engine, and more particularly to Ceramic Matrix Composites (CMC) vane structures therefor.

Gas turbine engine Low Pressure Turbine (LPT) vane structures are typically assembled as a multiple of cluster segments that together form a full ring. The segment interfaces may have multiple flow leakage paths. Feather seals and other structures minimize inter segment leakage; however, any leakage is an efficiency penalty that may be a factor in premature hardware failure should gas path air enter cavities where secondary cooling flow should reside.

SUMMARY

A vane structure for a gas turbine engine according to an exemplary aspect of the present disclosure includes a multiple of CMC airfoil sections integrated between a CMC outer ring and a CMC inner ring. The ring structure may form part of a Low Pressure Turbine.

BRIEF DESCRIPTION OF THE DRAWINGS

Various features will become apparent to those skilled in the art from the following detailed description of the disclosed non-limiting embodiment. The drawings that accompany the detailed description can be briefly described as follows.

DETAILED DESCRIPTION

Figure 1:
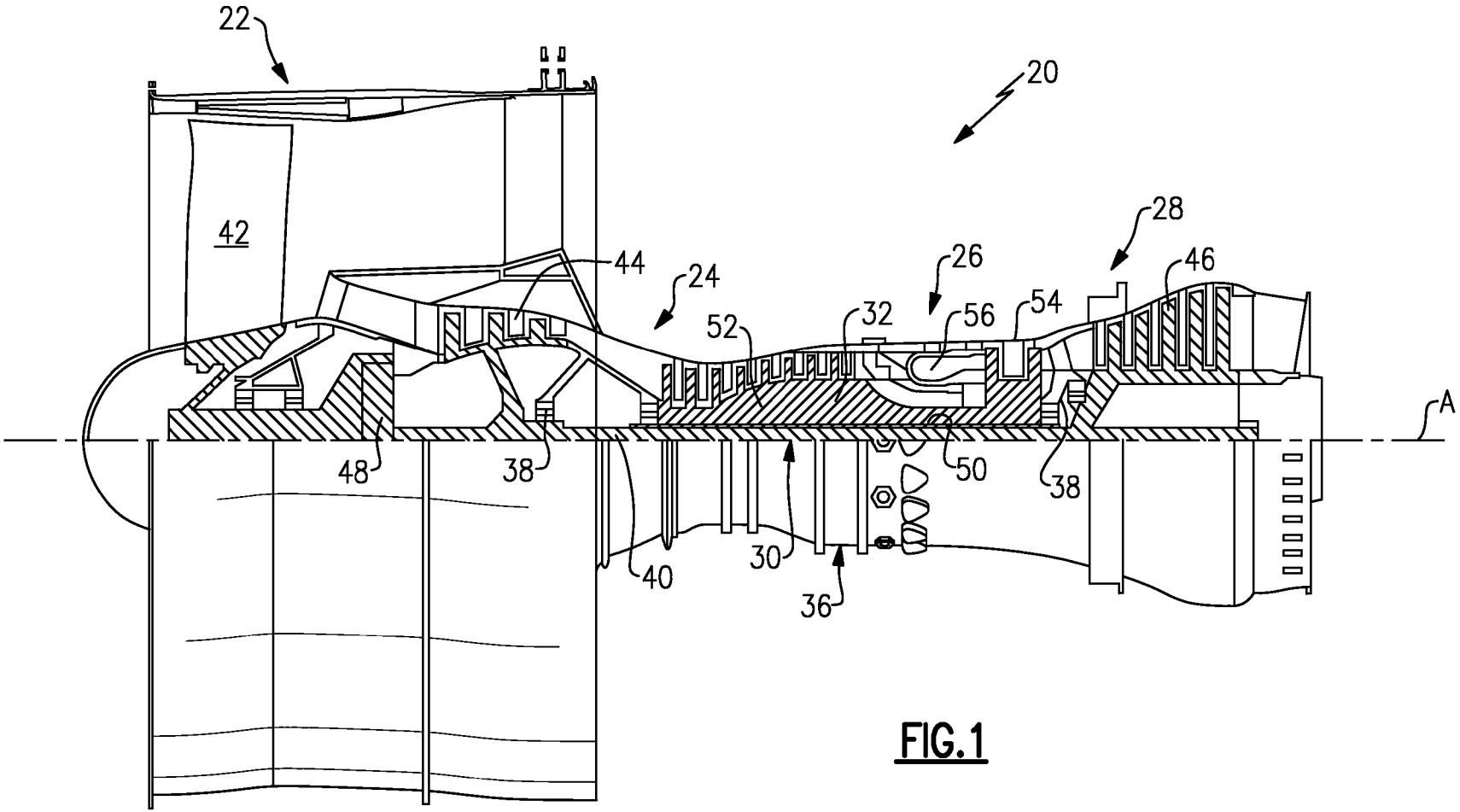
FIG. 1 is a schematic cross-section of a gas turbine engine.

FIG. 1 schematically illustrates a gas turbine engine 20. The gas turbine engine 20 is disclosed herein as a two-spool turbofan that generally incorporates a fan section 22, a compressor section 24, a combustor section 26 and a turbine section 28. Alternative engines might include an augmentor section (not shown) among other systems or features. The fan section 22 drives air along a bypass flowpath while the compressor section 24 drives air along a core flowpath for compression and communication into the combustor section 26 then expansion through the turbine section 28. Although depicted as a turbofan gas turbine engine in the disclosed non-limiting embodiment, it should be understood that the concepts described herein are not limited to use with turbofans as the teachings can be applied to other types of turbine engines.

The engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that interconnects a fan 42, a low pressure compressor 44 and a low pressure turbine 46. The inner shaft 40 is connected to the fan 42 through a geared architecture 48 to drive the fan 42 at a lower speed than the low speed spool 30. The high speed spool 32 includes an outer shaft 50 that interconnects a high pressure compressor 52 and high pressure turbine 54. A combustor 56 is arranged between the high pressure compressor 52 and the high pressure turbine 54. The inner shaft 40 and the outer shaft 50 are concentric and rotate about the engine central longitudinal axis A which is collinear with their longitudinal axes.

The core airflow is compressed by the low pressure compressor 44 then the high pressure compressor 52, mixed and burned with fuel in the combustor 56, then expanded over the high pressure turbine 54 and low pressure turbine 46. The turbines 54, 46 rotationally drive the respective low speed spool 30 and high speed spool 32 in response to the expansion.

Figure 2:
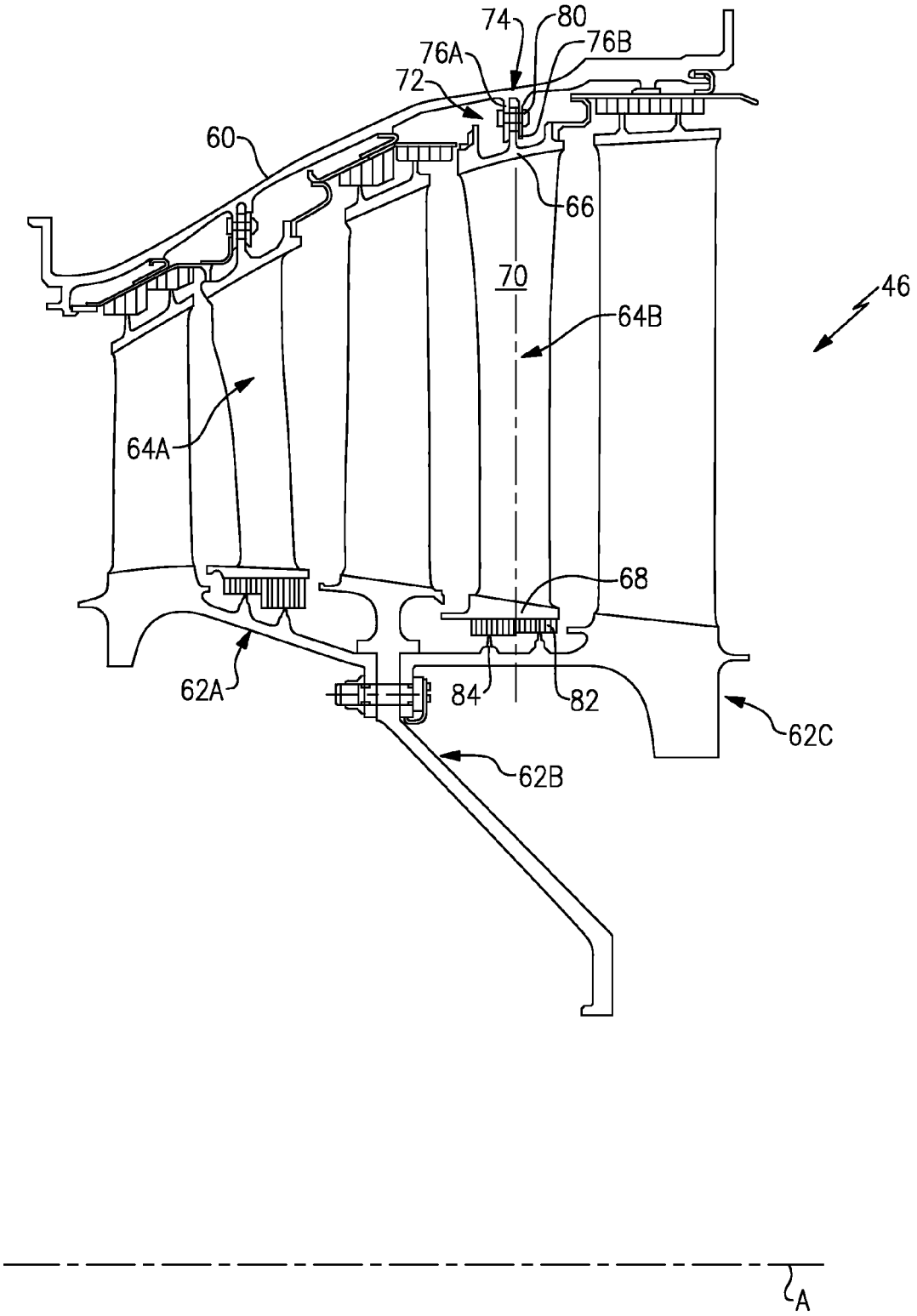
FIG. 2 is an enlarged sectional view of a Low Pressure Turbine section of the gas turbine engine.

With reference to FIG. 2, the low pressure turbine 46 generally includes a low pressure turbine case 60 with a multiple of low pressure turbine stages. In the disclosed non-limiting embodiment, the low pressure turbine case 60 is manufactured of a ceramic matrix composite (CMC) material or metal superalloy. It should be understood that examples of CMC material for all componentry discussed herein may include, but are not limited to, for example, S200 and SiC/SiC. It should also be understood that examples of metal superalloy for all componentry discussed herein may include, but are not limited to, for example, INCONEL 718 and WASPALOY. INCONEL 718 is a nickel-chromium-based superalloy and WASPALOY is a nickel-based superalloy, the compositions of which are known. Although depicted as a low pressure turbine in the disclosed embodiment, it should be understood that the concepts described herein are not limited to use with low pressure turbine as the teachings may be applied to other sections such as high pressure turbine, high pressure compressor, low pressure compressor and intermediate pressure turbine and intermediate pressure turbine of a three-spool architecture gas turbine engine, etc.

Rotor structures 62A, 62B, 62C are interspersed with vane structures 64A, 64B. It should be understood that any number of stages may be provided. Each vane structure 64A, 64B is manufactured of a ceramic matrix composite (CMC) material to define a ring-strut ring full hoop structure. CMC materials advantageously provide higher temperature capability than metal and a high strength to weight ratio. It should also be understood that various CMC manufacturability is applicable.

Figure 3:
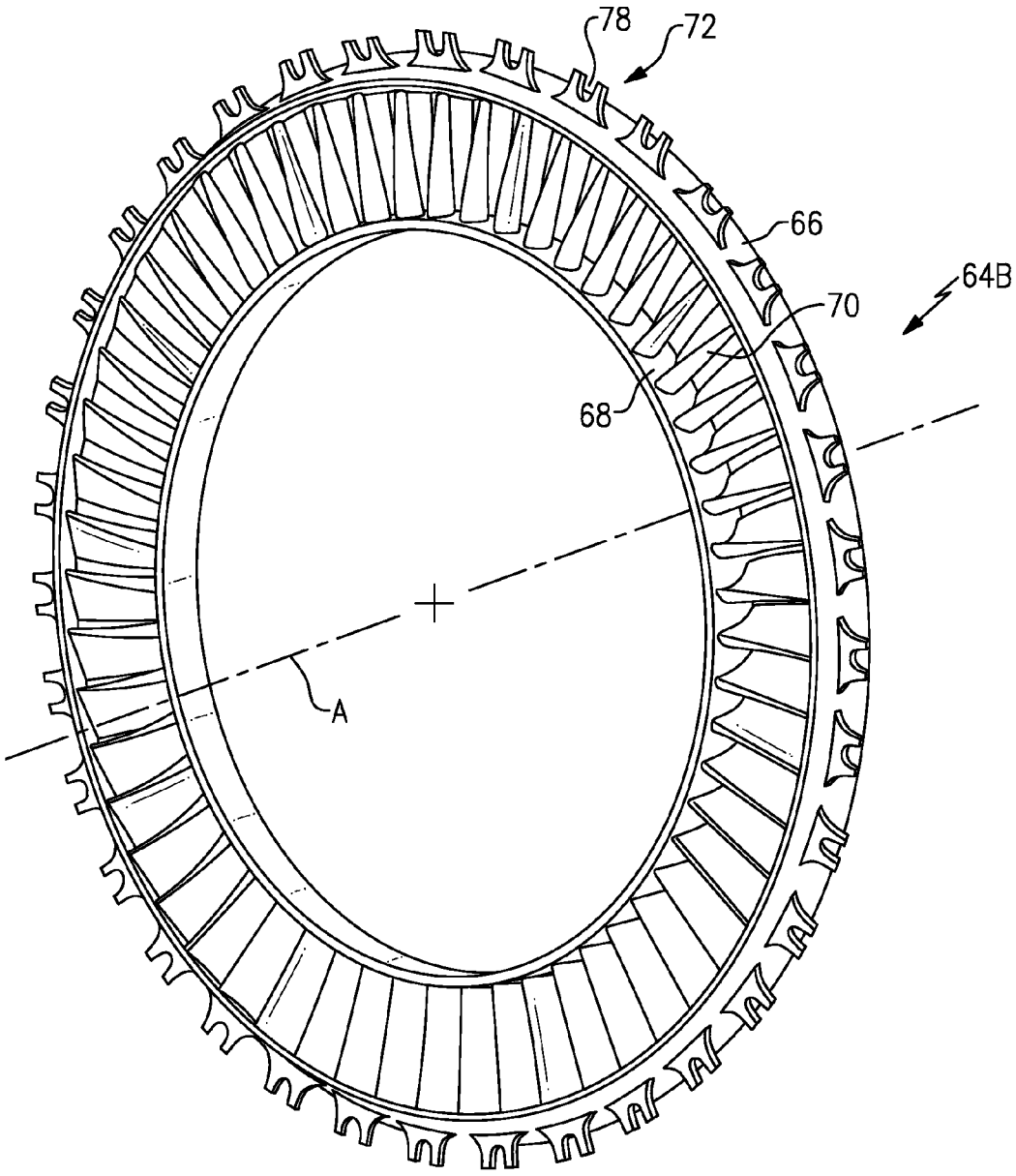
FIG. 3 is a perspective view of an example stator vane structure of the Low Pressure Turbine section.

The vane structure 64B will be described in detail hereafter; however, it should be understood that each of the vane structures 64A, 64B are generally comparable such that only the single vane structure 64B need be described in detail. The vane structure 64B generally includes a CMC outer ring 66 and a CMC inner ring 68 with a multiple of CMC airfoil sections 70 integrated therebetween (also illustrated in FIG. 3). The CMC outer ring 66 and the CMC inner ring 68 are essentially wrapped about the multiple of integrated airfoil sections 70 to form full hoops. It should be understood that the term full hoop is defined herein as an uninterrupted member such that the vanes do not pass through apertures formed therethrough. The full hoop ring design maximizes the utilization of the CMC material fiber strength in a full hoop configuration.

The full hoop CMC outer ring 66 includes a splined interface 72 (also illustrated in FIG. 3) for static hardware attachment to the low pressure turbine case 60 which includes a support structure 74 which extends radially inward toward the engine axis A. The support structure 74 includes paired radial flanges 76A, 76B which receive the splined interface 72 therebetween. The splined interface 72 is axially centered along the airfoil sections 70 and includes open slots 78 to receive a fastener 80 supported by the paired radial flanges 76A, 76B. The open slots 78 permit a floating ring structure which accommodates radial expansion and contraction due to thermal variances yet maintains the concentricity of the vane structure 64B about engine axis A.

The full hoop inner ring 68 may support an abradable material 82 which may be formed or otherwise bonded to the full hoop inner ring 68. The abradable material 82 provides for trenching by complimentary knife edge seals 84 as generally understood.

The full hoop ring vane structure eliminates inter-segment leakages and improves LPT efficiency. The weight of the hardware is also less than conventional structures not based on material density variations alone, but on the lack of need for inter-segment hardware such as featherseals, nuts and bolts which streamlines the design space and assembly of the structure.

It should be understood that like reference numerals identify corresponding or similar elements throughout the several drawings. It should also be understood that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For that reason the appended claims should be studied to determine true scope and content.

What is claimed is:

1. A vane structure for a gas turbine engine comprising:

a CMC outer ring;

a CMC inner ring, each of said CMC outer ring and said CMC inner ring is a full, uninterrupted hoop, and each of said CMC outer ring and said CMC inner ring are uninterrupted with respect to vane pass-through apertures;

a multiple of CMC airfoil sections integrated between said CMC outer ring and said CMC inner ring; and a splined interface extending from an outer surface of said CMC outer ring, said splined interface is axially centered relative to said multiple of CMC airfoil sections.

2. The vane structure as recited in claim 1, wherein said multiple of CMC airfoil sections are within a low-pressure turbine.

3. The vane structure as recited in claim 1, wherein said multiple of CMC airfoil sections are within a high-pressure compressor.

4. The vane structure as recited in claim 1, wherein said splined interface includes open slots.

5. The vane structure as recited in claim 1, further comprising an abradable material mounted to said CMC inner ring.

6. The vane structure as recited in claim 1, further comprising a low pressure turbine case, said CMC outer ring mounted to said low pressure turbine case through said splined interface.

7. The vane structure as recited in claim 6, wherein said low pressure turbine case is manufactured of CMC.

8. The vane structure as recited in claim 6, further comprising a support structure which extends radially inward from said low pressure turbine case.

9. The vane structure as recited in claim 8, wherein said support structure axially traps said splined interface therebetween.

10. The vane structure as recited in claim 9, wherein said support structure includes paired radial flanges.

11. The vane structure as recited in claim 1, further comprising an abradable material mounted to said CMC inner ring.

12. The vane structure as recited in claim 1, wherein said CMC outer ring and said CMC inner ring are each annularly wrapped such that there is a CMC material fiber strength in a full hoop configuration.

* * * * *